US006876311B2

(12) United States Patent
Sommerfeld et al.

(10) Patent No.: US 6,876,311 B2
(45) Date of Patent: Apr. 5, 2005

(54) SPINDLE MOUNTED TELEMETRY SYSTEM

(75) Inventors: Jodi L. Sommerfeld, Bloomington, MN (US); Richard A. Meyer, Chaska, MN (US); Brett A. Larson, Bloomington, MN (US); Douglas J. Olson, Plymouth, MN (US)

(73) Assignee: MTS Systems Corporation, Eden Prairie, MN (US)

( * ) Notice: Subject to any disclaimer, the term of this patent is extended or adjusted under 35 U.S.C. 154(b) by 550 days.

(21) Appl. No.: 10/083,939

(22) Filed: Feb. 27, 2002

(65) Prior Publication Data

US 2002/0118120 A1 Aug. 29, 2002

Related U.S. Application Data

(60) Provisional application No. 60/271,875, filed on Feb. 27, 2001, and provisional application No. 60/352,755, filed on Jan. 28, 2002.

(51) Int. Cl.[7] ..... G08C 15/06

(52) U.S. Cl. ..... 340/870.07; 340/442; 73/146; 301/126

(58) Field of Search ..... 340/870.07, 442; 73/146; 301/126

(56) References Cited

U.S. PATENT DOCUMENTS 4,637,488 A * 1/1987 Fotheringham et al. ..... 180/253
5,103,126 A * 4/1992 Mehnert ..... 310/80
5,193,387 A 3/1993 Hodate ..... 73/146.5
5,381,090 A * 1/1995 Adler et al. ..... 324/174
5,939,977 A * 8/1999 Monson ..... 340/442
5,969,268 A 10/1999 Sommerfeld et al. .. 73/862.041

FOREIGN PATENT DOCUMENTS

DE 30 15 559 A1 10/1981
EP 0 799 728 A2 10/1997

* cited by examiner

*Primary Examiner*—Timothy Edwards
(74) *Attorney, Agent, or Firm*—Westman, Champlin & Kelly,P.A.; Todd R. Fronek

(57) ABSTRACT

The present invention relates to a telemetry assembly for a spindle. The telemetry assembly includes a wireless transmitter coupled to the spindle to rotate therewith and a receiving antenna wirelessly coupled to the transmitter. A guiding system having a central aperture and coupled to the wireless transmitter and the receiving antenna guides rotation of the wireless transmitter relative to the receiving antenna. If desired, the telemetry assembly can be used in a telemetry system including a hub adapter mountable to the spindle and a transducer mountable to the hub adapter. Furthermore, an angular positioning device and a wireless power coupling can be provided.

47 Claims, 12 Drawing Sheets

SPINDLE MOUNTED TELEMETRY SYSTEM

CROSS REFERENCE TO RELATED APPLICATION

The present application is based on and claims the benefit of U.S. provisional patent applications Ser. No. 60/271,875, filed Feb. 27, 2001 and Ser. No. 60/352,755, filed Jan. 28, 2002, the contents of which are hereby incorporated by reference in their entireties.

BACKGROUND OF THE INVENTION

The present invention relates to a transducer mounted to a spindle. More particularly, the present invention relates to a telemetry system that transmits signals from the rotating transducer to a stationary body.

A common system for transmitting signals from a rotating transducer to a stationary member is by using a contacting slip ring. In vehicle spindle mounted applications, the slip ring, as well as an optional angular encoder, require an anti-rotate connection to a non-spinning portion of the vehicle. Most slip rings also require that the slip ring tracks and brushes be located on a small radius around the axis of rotation for the purposes of decreasing the surface speed of the brushes in the slip ring assembly. Typically, this requires that the slip ring assembly be placed outboard of the vehicle wheel assembly on the axis of rotation. The antirotate connection wraps around the outside of the wheel assembly to attach on the inside of the wheel at the suspension such that the antirotate is attached to a non-rotating portion of the vehicle that follows the wheel steering and bounce so as to avoid relative motion of the vehicle mounting location and the slip ring mounting at the spindle. Accordingly, the slip ring assembly thus projects outwardly from the wheel, which is undesirable since the projection may contact obstacles. In many jurisdictions, local street laws may prohibit driving on public roads with such a projection.

As an alternative to a slip ring, telemetry allows signals from a rotating body to be transmitted wirelessly to a stationary body. Telemetry can have some advantages over slip rings in that it does not rely on a brush contact to transmit the signal. Although telemetry has been incorporated into other vehicle spindle applications, such systems have had many separate components and which are positioned on the rotating and non-rotating portions of the vehicle spindle. In these other assemblies, the spindle bearings provide the means or positioning for components rotating relative to each other. This design may require electrical components to be potted into custom rims. The custom rims are expensive and require alignment of a stationary pick-up device during installation. In addition, the runout of a rim and/or spindle bearings, and/or deformation of the rim under loading can create problems and interferences between the rotating rim components, and the stationary suspension or vehicle mounted components due to varying gap between the stationary body and the rotating body.

In another telemetry system, the telemetry assembly is comprised of a rotor and stator portion, which must be placed on the axis of rotation to maintain low bearing and/or seal speeds and use of standard off the shelf encoder products. Due to the existing vehicle spindle geometry, which occupies the space at the axis of rotation, the telemetry assembly must be placed outboard of the wheel on the axis of rotation. An anti-rotate device must again wrap around the wheel to an attachment point behind the wheel, thereby having the disadvantages discussed above with the slip ring assembly. In addition, these systems are not easily adapted to other wheels or environments.

Accordingly, there is an on-going need to improve telemetry systems in rotating applications such as vehicle spindle or helicopter spindle blade applications. A telemetry system that addresses one or more of these problems would be a valuable design improvement to the current state of the technology.

SUMMARY OF THE INVENTION

The present invention relates to a telemetry assembly for a spindle. The telemetry assembly includes a wireless transmitter coupled to the spindle to rotate therewith and a receiving antenna wirelessly coupled to the transmitter. A guiding system is coupled to the wireless transmitter and the receiving antenna to guide rotation of the wireless transmitter relative to the receiving antenna.

In one embodiment, the telemetry assembly can be used in a telemetry system that includes a hub adapter mountable to the spindle and a transducer mountable to the hub adapter. Housings may be provided in order to support the wireless transmitter and the receiving antenna. The housings may be annular in design and include a central aperture so as to allow the telemetry assembly to be placed concentrically with the existing spindle bearings, thus allowing the location of the telemetry system to be maintained inboard of the wheel assembly wherein at least one of the spindle or a non-rotating member of the spindle extends through the central aperture and thus simplify the antirotate attachment and minimize the protrusion from the face of the spindle.

The telemetry assembly is easily mountable to various types of spindles. A stator housing of the telemetry assembly is mountable to a non-rotating element of the spindle. An antirotate connection assembly secures the stator housing to the non-rotating element. The stator housing can be disposed between the connection assembly and a rotor housing.

The guiding system provides for independent control of the position and rotation of the rotor relative to the stator, thus eliminating the dependency on spindle bearing accuracy, and/or manual alignment of other separate telemetry components such as electronic-embedded rims and stationary receivers, to maintain the relative positions of the rotor and stator portions of the telemetry system. A central aperture is provided in the guiding system to allow the spindle or rotating members coupled to the spindle to extend therethrough.

The housings provide a compact, modular, self-guided assembly that is easily mountable to various types of spindles. In particular, the housings are particularly useful in mounting to various vehicles, including different types of automobiles. If desired, an angular positioning device and a wireless power coupling can be used with or incorporated within the telemetry system.

DETAILED DESCRIPTION OF THE ILLUSTRATIVE EMBODIMENTS

Figure 1:
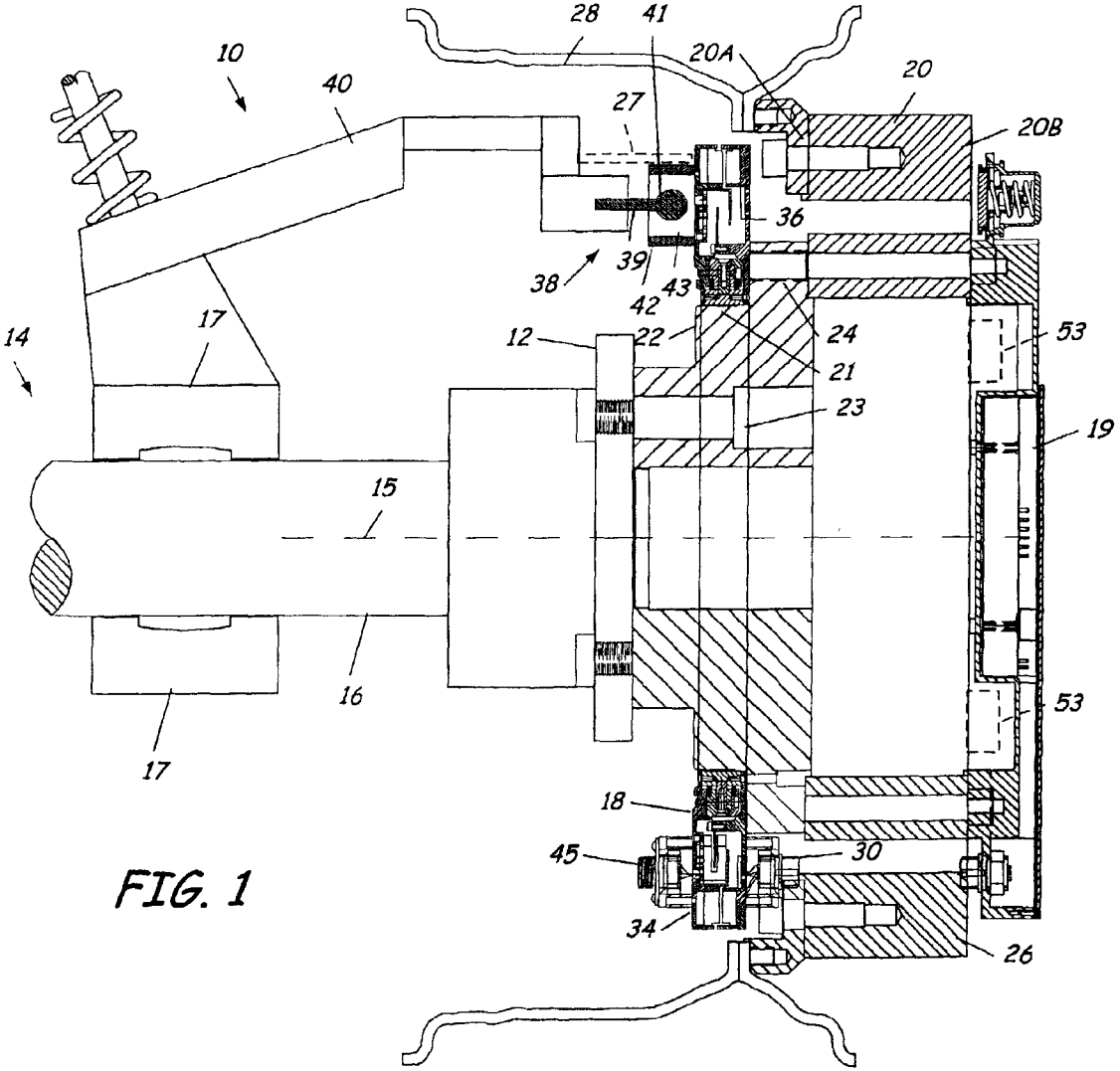
FIG. 1 is a sectional view of a wheel assembly of a vehicle spindle.

Referring to FIG. 1, a telemetry system 10 includes a telemetry assembly 18 and transducer 20 that are mountable to a hub 12 of a spindle 14 (herein by example a vehicle spindle). Spindle 14 has a spindle axis 15 about which rotating elements rotate relative to non-rotating elements. Hub 12 is connected to a shaft 16 that rotates on vehicle spindle bearings 17, schematically illustrated. Generally, the telemetry system 10 includes the telemetry assembly 18 and optional hub electronics 19. The telemetry assembly 18 is couplable to a transducer 20 (herein a force transducer) that measures forces and loads upon the vehicle spindle 14, although other forms of transducers such as displacement, acceleration, temperature and pressure transducers mounted to the vehicle spindle 14 can also be used. The telemetry assembly 18 can be disposed on a side 20A of the transducer 20 facing the hub 12 to form a compact system with minimal projection from the vehicle spindle.

Figure 2:
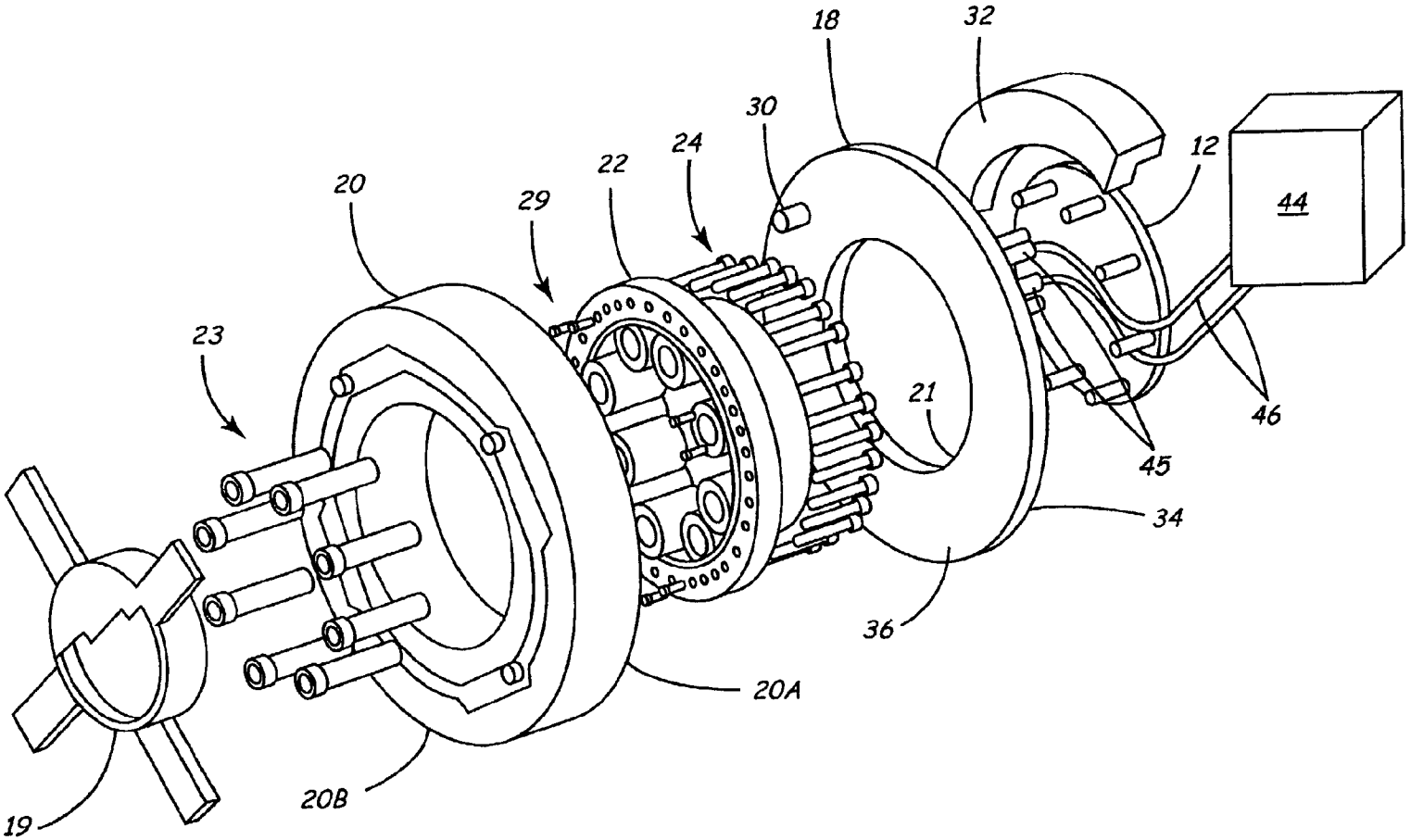
FIG. 2 is an exploded perspective view of the telemetry and wheel assembly.

Referring also to FIG. 2, transducer 20 is coupled to hub 12 of the vehicle spindle 14. In the embodiment illustrated, a hub adapter 22 is secured to the hub 12, while the transducer 20 is secured to the hub adapter 22. In some applications, a hub adapter 22 may not be necessary. The hub adapter 22 allows the transducer 20 to be easily used on many types of hubs 12. Fasteners 23 secure the hub 12 to the hub adapter 22, while fasteners 24 secure the transducer 20 to the hub adapter 22. In the embodiment illustrated, the transducer can comprise a force and moment transducer wherein an outer rim 26 of the transducer 20 is secured to a wheel rim 28 supporting a tire not shown. This type of transducer is described in U.S. Pat. No. 5,969,268, which is hereby incorporated by reference in its entirety, although other forms of transducers can benefit from the telemetry system 10 or telemetry assembly 18 herein described.

Generally, the transducer 20 has a first side 20A facing the hub 12 and a second side 20B facing in an opposite direction away from the hub 12. The telemetry system 10 includes hub electronics 19 coupled to the transducer 20 to rotate therewith. Hub electronics 19 includes circuitry (digitization, telemetry conversion, signal conditioning and/or amplification to name a few) that is disposed on the second side 20B of the transducer facing away from the hub 12. Due to the annular design of the telemetry system 10, the telemetry assembly 18, can be positioned concentrically about the axis 15 with the spindle bearings 17 and can be positioned on the first side 20A of the transducer 20, which faces the hub 12 and is coupled to hub adapter 22 via fasteners 29. One or more connectors 30 connect telemetry assembly 18 to circuits of hub electronics 19 and/or transducer 20. The telemetry assembly 18 can thus be disposed between the transducer 20 and elements of the spindle 14 such as a brake caliper 32. Location of the telemetry assembly 18 between transducer 20 and components of the spindle 14 forms a compact assembly, with benefits such as minimizing hanging mass on the spindle 14. Location of the hub electronics 19 on the other side 20B of the transducer 20 minimizes the heat seen by components forming the hub electronics 19, the heat being substantially generated by operation of the brakes to stop the vehicle. Meanwhile, less sensitive components of the telemetry system 10, and data and power transmitting components are located inwardly of the transducer 20 to form a compact assembly.

The telemetry assembly 18 includes central aperture 21 and two portions 34 and 36 that rotate relative to one another. Generally, the first portion 34 (or stator portion) is held substantially stationary with respect to the non-rotating portions of the spindle or elements proximate thereto. As illustrated, the stator portion 34 and rotor portion 36 are rings that rotate relative to one another via a guiding system 72, discussed in detail below. By locating the telemetry assembly 18 as a ring about the axis of rotation on side 20A of the transducer 20, a large, cumbersome anti-rotate device disposed around the tire and wheel assembly is also not needed. Central aperture 21 allows portions of spindle 14 or rotating members coupled to the spindle 14 to extend therethrough. Although illustrated as rings or plate members facing each other, those skilled in the art will recognize that concentric rings or cylinders and other designs may be used for stator portion 34 and rotor portion 36. In the embodiment illustrated, rotor portion 36 is coupled to hub adapter 22 via fasteners 30 to rotate therewith. Although, if desired, the rotor portion 36 can also be coupled to the force transducer 20 or any other rotating element.

In the embodiment illustrated in FIG. 1, anti-rotate connection assembly 38 holds stator portion 34 substantially stationary (i.e. at least not rotating with rotor portion 36) with respect to a non-rotating portion of the spindle, such as spindle element 40. Connection assembly 38 can be attached to elements of vehicle spindle 14 or other non-rotating spindle elements which move with the hub 12 translationally and rotate in axes other than the spinning rotation, such as brake caliper 32 (FIG. 2) and allows telemetry assembly 18 to be spaced apart from rim 28. Connection assembly 38 includes an elongated member 39 secured to spindle element 40 (which is non-rotating). As illustrated, connection assembly 38 includes a ball 41 disposed in a ball receiver 42 having a cavity 43 with sufficient clearance to allow the ball 41 to move relative to the cavity 43 to respond to various alignment positions of the antirotate assembly 38 relative to the telemetry assembly 18.

Figure 4:
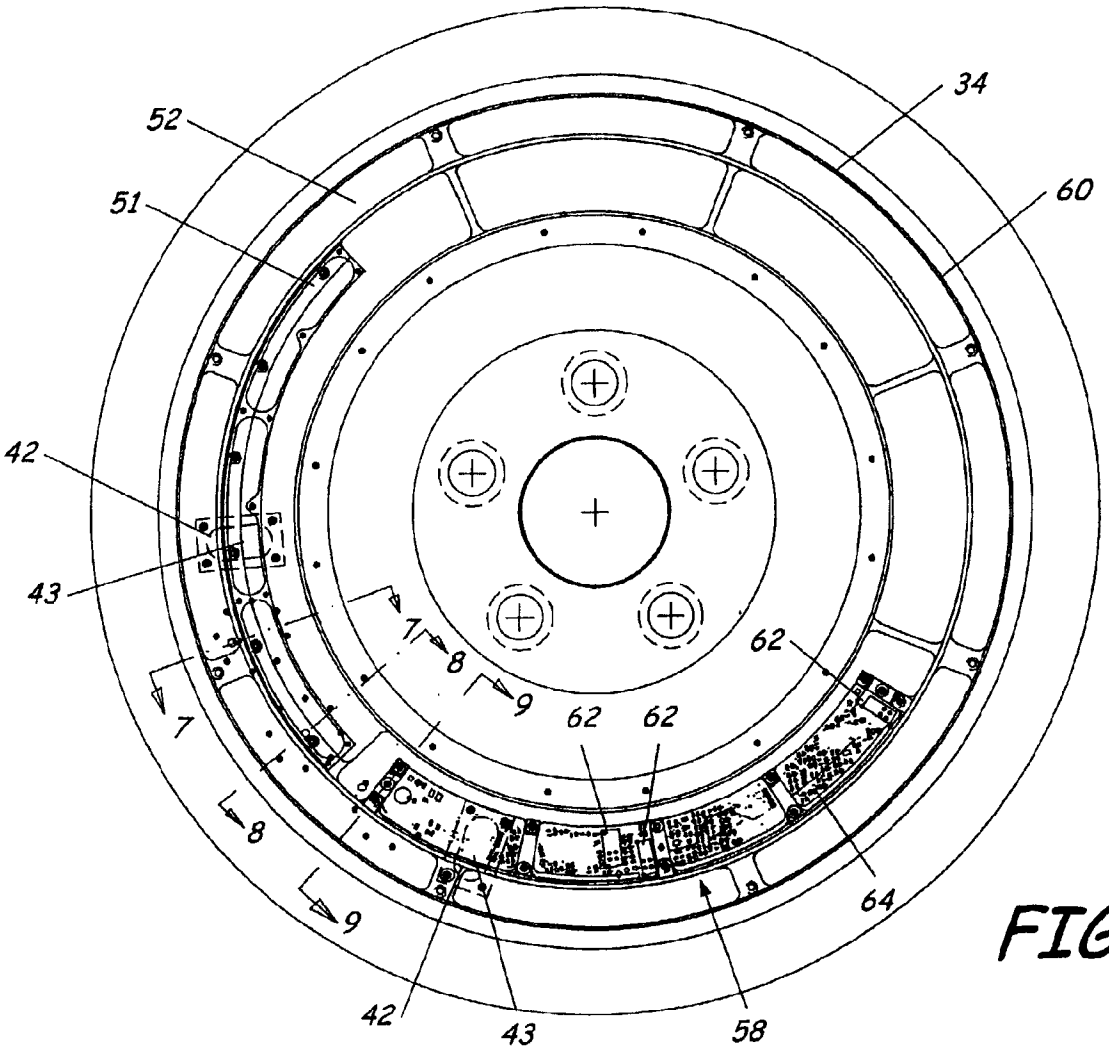
FIG. 4 is a top plan view of a first portion from inside the telemetry assembly.

Generally, connection assembly 38 inhibits movement of stator portion 34 about spindle axis 15 while allowing limited movement in the remaining linear and rotational displacements of a mutually orthogonal coordinate system having an axis coincident with spindle axis 15. If desired, elongated member 39 may be mounted to the stator portion 34 and the ball receiver 42 mounted to spindle element 40. The illustrated embodiment includes one connection assembly 38, wherein two ball receivers 42 are illustrated in FIG. 4 to allow for alternate positioning. Alternatively, one or more connection assemblies 38 may be used. In addition, other connection assemblies may be used such as one or more straps 27, for example. Since the telemetry assembly 18 includes central aperture 21 through which a portion of spindle 14 or elements connected thereto can extend, the connection assembly 38 can be mounted inboard on side 20A of the transducer 20, or at a radial position from the axis 15 less than the maximum radial distance of a rotating element of the spindle 14, for example transducer 20 or rim 28. Accordingly, rotation of elements coupled to spindle 14 can take place around connection assembly 38.

Referring to FIG. 2, signals indicative of forces sensed by transducer 20 are sent to telemetry assembly 18 and wirelessly transmitted from rotor portion 36 to stator portion 34. These signals are then transmitted to transducer interface 44 via connectors 45 and cables 46 for data collection. Shielding may be provided to protect connectors 45 and cables 46 from heat generated by a rotor of the wheel assembly. In a further embodiment, power is inductively transmitted from transducer interface 44 or other separate power supply to stator portion 34 via cables 46 and connectors 45. Power can then be transmitted to rotor portion 36 and provide power to the circuitry of hub electronics 19 and/or transducer 20. Alternatively, if desired, other power cells 53 such as batteries or solar cells can be mounted to rotate with the transducer 20 and wheel assembly to power some or all of these components.

Figure 3:
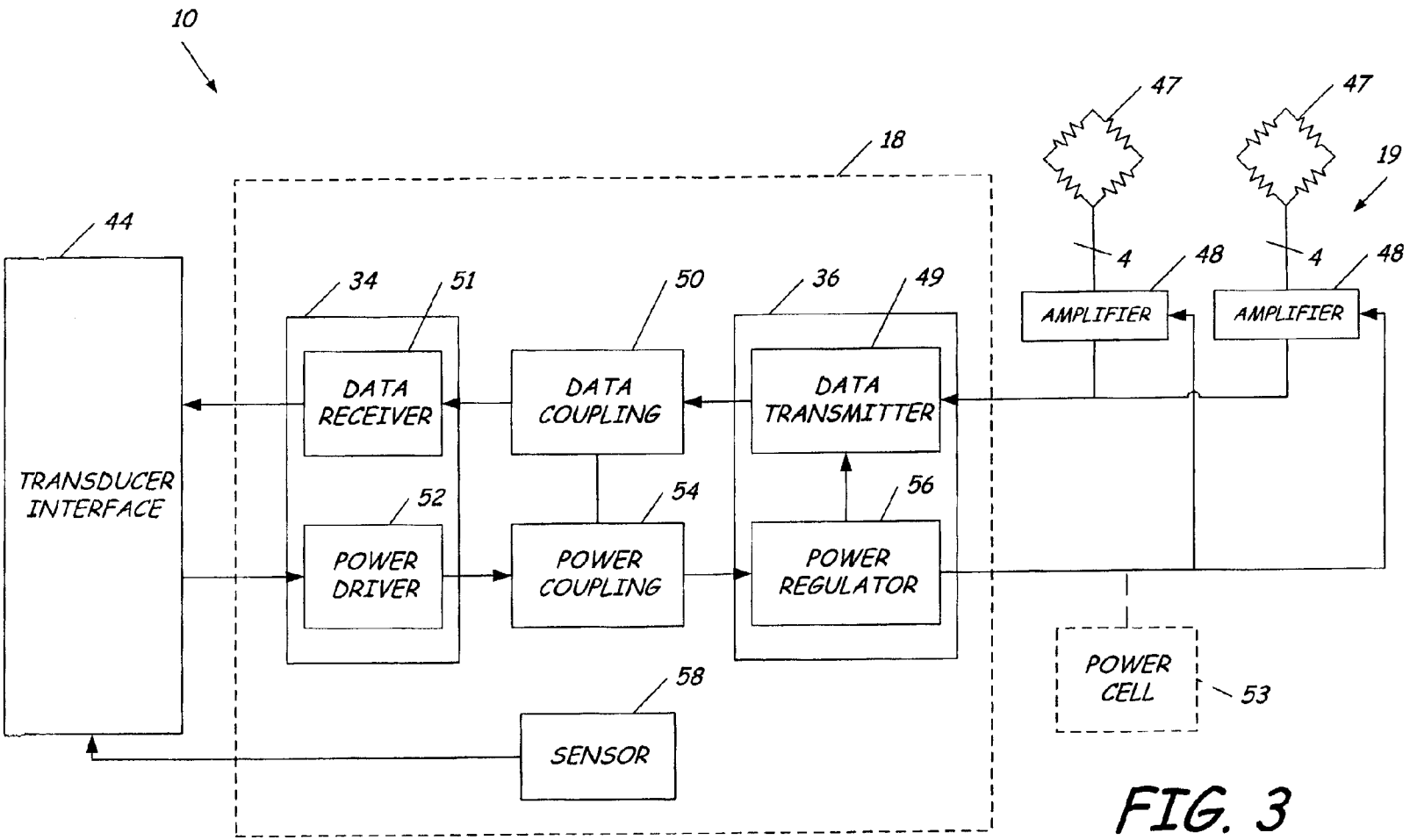
FIG. 3 is a schematic block diagram of a telemetry system.

FIG. 3 illustrates a block diagram of telemetry system 10. In the exemplary embodiment, sensors 47 sense forces that are amplified by amplifiers 48. From amplifiers 48, signals are sent to data transmitter (or wireless transmitter) 49, which is coupled to rotor portion 36. Data transmitter 49 wirelessly transmits data through data coupling 50 to data receiver (or receiving antenna) 51, which is coupled to stator portion 34. Data receiver 51 is a ring or arced assembly about spindle axis 15. Data transmitter 49 and data receiver 51 are spaced apart from each other. Data transmitter 49 generally travels in a circular path spaced apart from and opposed to data receiver 51. Transmitted signals can be analog, digital or any combination thereof. In one embodiment illustrated, each channel is sampled at 20,000 samples per sec, and wherein eight channels of data are multiplexed for transmission. After receipt by the data receiver 51, the digital signals can be used as digital data or converted to analog signals, as desired. The signals are provided to a recorder or data acquisition system through transducer interface 44. In one embodiment, transducer interface 44 includes a separate board (daughter board) for each spindle, the separate board being coupled to a mother board.

Transducer interface 44 or other power supply can also provide power to power driver 52. Power driver 52 transmits power through power coupling 54 to power regulator 56. In one embodiment, power coupling 54 is an inductive coupling wherein power driver 52 and power regulator 56 are spaced apart from each other and are couplable to each other in order to transfer electrical power. In a further embodiment, power driver 52 and power regulator 56 are coils that each form an annular ring about the spindle axis 15.

Typically, there is a need to know the angular position of transducer 20 as it rotates with the hub 12. If desired, telemetry assembly 18 can include sensor 58 operably coupled to the stator portion 34 and rotor portion 36 to sense the angular position of rotor portion 36 relative to stator portion 34. Generally, sensor 58 can be a resolver or an incremental or absolute encoder. The sensor 58 generally operates under optical, magnetic, resistive, capacitive, hall-effect, or other techniques.

Figure 5:
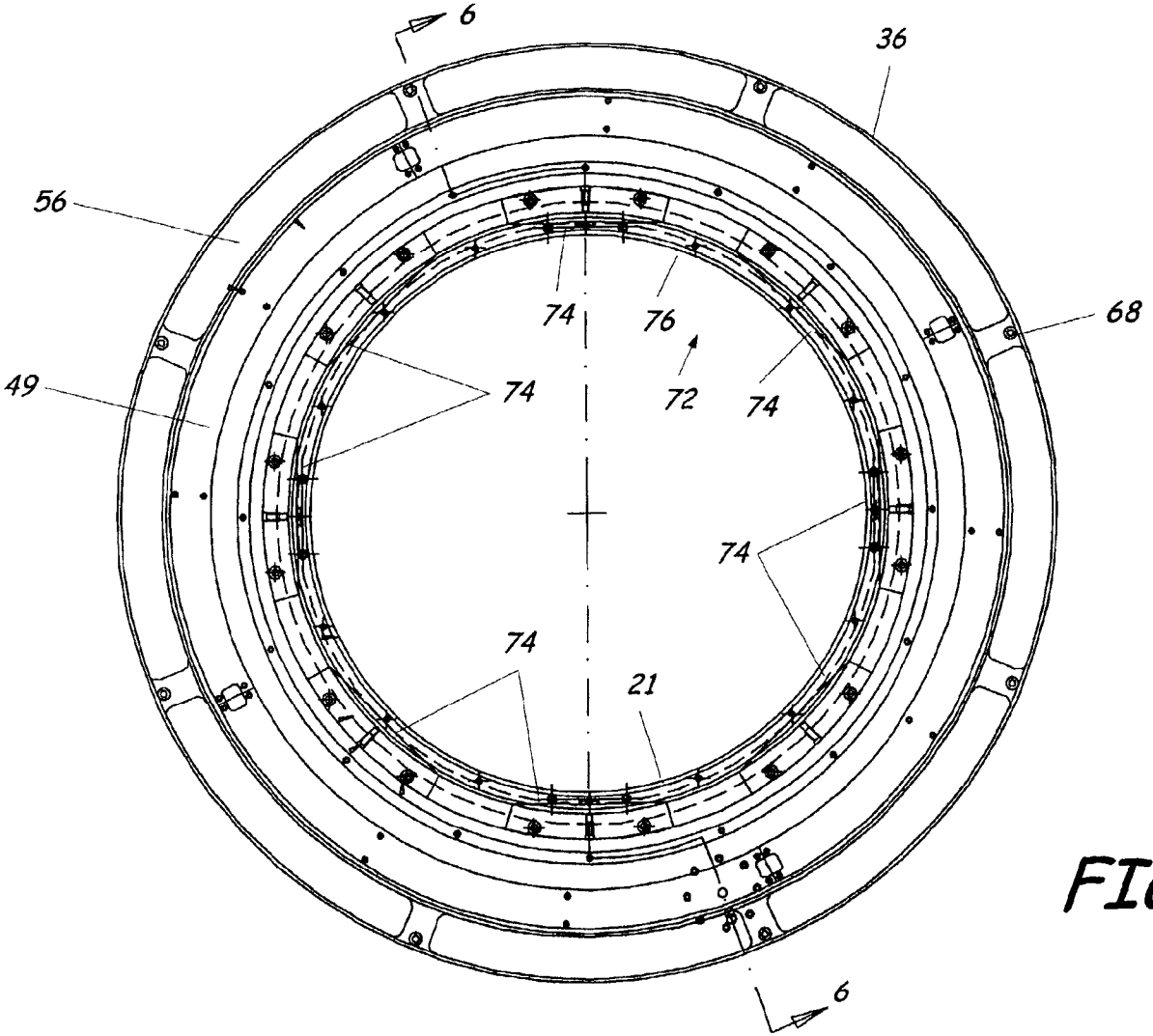
FIG. 5 is a top plan view of a second portion from inside the telemetry assembly.
Figure 6:
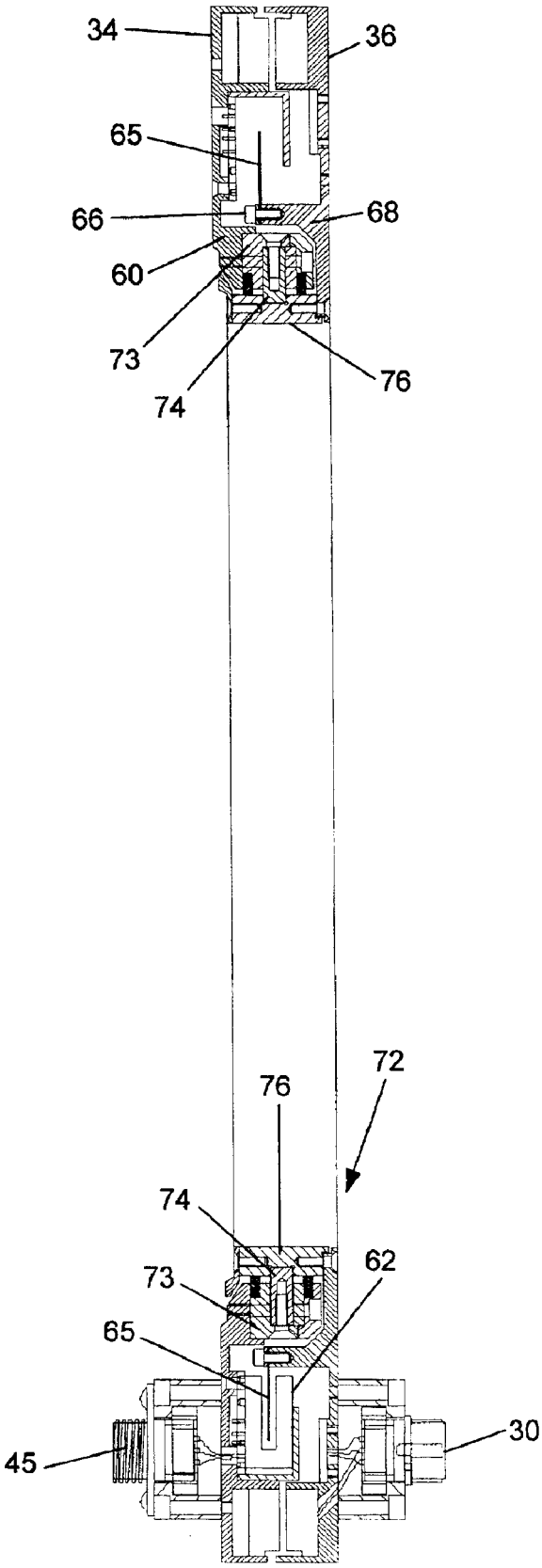
FIG. 6 is a sectional view of the telemetry assembly taken along line 6—6 of FIG. 5.

FIGS. 4–6 illustrate different views of components of telemetry assembly 18. FIG. 4 illustrates a view of stator 34 from inside telemetry assembly 18. As illustrated, stator portion 34 includes stator housing 60 that is an annular ring including ball receivers 42 that couple to antirotate connection assemblies, such as connection assembly 38 illustrated in FIG. 1. In particular, ball receivers 42 include cavities 43 for receiving balls 41 (FIG. 1). The width of the cavities 43 corresponds to the diameter of the balls 41 in order to inhibit rotation of the stator portion 36, while the radial length (from axis 15) and the depth (FIG. 1) allow movement of the ball 41 in each of the cavities 43.

In the embodiment illustrated, data receiver 51 is an arced assembly positioned on stator housing 60. Power driver 52 is an annular ring that is also positioned on stator housing 60. Sensor 58 is also illustrated and includes one or more optical sensing devices 62 and encoder circuitry 64. Optical sensing devices 62 sense the position of rotor portion 36 and provide an output signal indicative thereof. The optical sensing device or devices 62 senses a reference position on the rotor, possibly through quadrature feedback signals and indexing as in known in the art. The use of quadrature output signals allows the direction of rotation of rotor portion 36 to be determined. In one embodiment, two of the optical sensing devices 62 provide square wave periodic signals substantially in quadrature (defined by a phase shift of 90°) indicative of direction. The encoder 64 interprets rotational position data provided by the optical sensing devices 62 and sends the corresponding signals to transducer interface 44.

With reference also to FIG. 6, a side view of one possible optical sensing device 62 is shown. Optical sensing device or devices 62 are configured to sense the presence of indications on a disk 65, which is coupled to rotor portion 36 with fasteners 66 to rotate therewith.

FIG. 5 illustrates a view of rotor portion 36 from inside telemetry assembly 18. As illustrated, rotor portion 36 includes rotor housing 68. Data transmitter 49 and power regulator 56 are both annular rings positioned on rotor housing 68.

With reference also to FIGS. 6–9, guiding system 72 is shown. Generally, guiding system 72 maintains alignment of stator portion 34 and rotor portion 36 during relative rotation thereof. In particular, guiding system 72 maintains a substantially constant gap between data transmitter 49 and data receiver 51. A substantially constant gap between power driver 52 and power regulator 56 is also maintained. The position of the encoder components is also maintained. The gaps allow proper transmission of data and power through data coupling 50 and power coupling 54, and angular sensing. It is understood that an annular self guided assembly as this may include any single or combination of functions described above, as desired for various applications.

Figure 7:
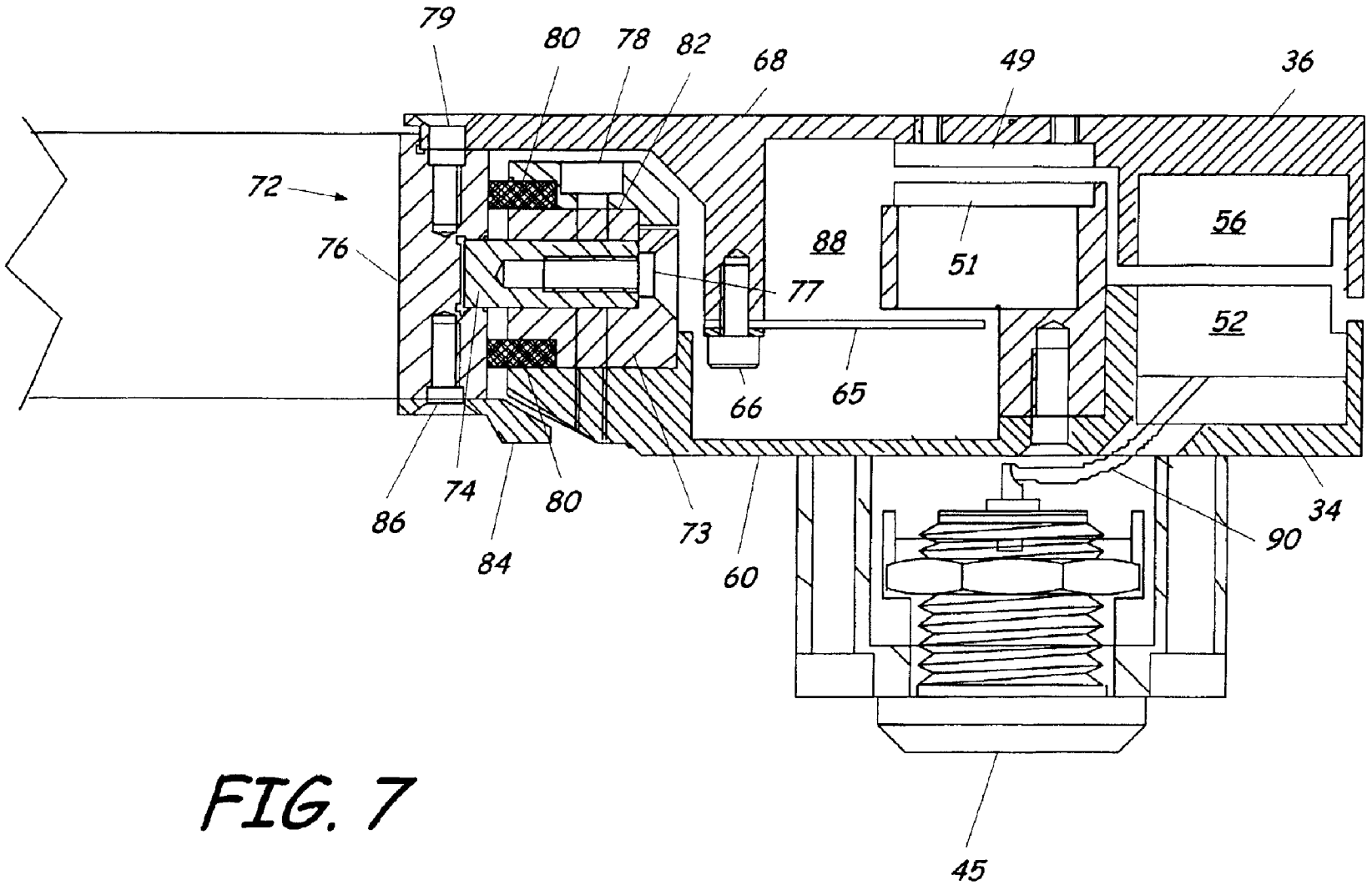
FIGS. 7–9 are sectional views of the telemetry assembly taken along lines 7—7, 8—8 and 9—9 of FIG. 4, respectively.

Referring to the embodiment illustrated in FIG. 7, guiding system 72 can include bearing pad housing 73, bearing pads 74 and a cylindrical bearing race 76 that includes a guided groove that couples to bearing pads 74. Bearing pads 74 are equally spaced apart about spindle axis 15. Bearing pads 74 are secured to bearing pad housing 73 with fasteners 77. Bearing pad housing is secured to stator portion 34 with fasteners 78. Although illustrated as a plurality of bearing pads 74, a single bearing pad or ring may also be used. Bearing race 76 is secured to rotor portion 36 with fasteners 79. Similarly, the location of the bearing pads 74 could be moved to the rotating side, and the groove to the non-rotating side of the telemetry assembly 12 in a location similar to pad housing 73 Suitable materials for bearing pads 74 and bearing race 76 include aluminum, hard-coated materials, stainless steel and various other types of metallic, nonmetallic, intermetallic, ceramic, composite, metal filled or backed plastics, lubricant filled self lubricating materials, thermoset plastic, thermoplastic or other similar materials, or combinations thereof. Examples of hard-coated materials include hard-coated aluminum, hard anodize aluminum material, nickel plated material and chrome plated material. Further, the materials for pad 74 and race 76 can include bearing grade polymers, engineering plastics, synthetic resin materials, polyimide resins, polymerethane, PEEK (polyaryletheretherketone), phenolic and various compositions of these with fillers such as graphite or Teflon®, for example graphite filled polyimides such as Duratron® and Vespel®. Various combinations of these materials may be applied to provide an adequate bearing. For example, pad 74 may be made of stainless steel while a groove in race 76 is made of PEEK. Alternatively, a PEEK pad may be disposed in a stainless steel groove. Although the guiding system 72 described above is particularly advantageous due to its ability to handle heat and corrosive environments, guiding system 72 can be any rotational guiding system including ball bearings, air bearings, magnetic levitation, etc.

Seals 80 inhibit contaminants from the bearing pad 74 and bearing race 76 coupling. Spacer 82 is provided to space one of the seals 80 from bearing pad 74. Seals 80 can be leather, plastic, Teflon®, rubber, wool, felt, polypropylene felt, synthetic or material for example formed from aramid such as Conex® felt, Nomex® felt and other materials, and/or combinations thereof. A flange 84, coupled to the bearing race 76 via fasteners 86, further shields contaminants from entering the guiding system 72 by producing a labyrinth, and reduces a gap between stator housing 60 and rotor housing 68 proximate the guiding system 72.

Stator housing 60 and rotor housing 68 face each other to form a cavity 88. Data transmitter 49, data receiver 51, power driver 52, power regulator 56, sensor 58, optical sensing devices 62, encoder 64 and other elements can be disposed in cavity 88. If desired, additional seals may be used to prevent unwanted entry of dirt, oil and other contaminants from entering between stator housing 60 and rotor housing 68 into cavity 88.

Figure 8:
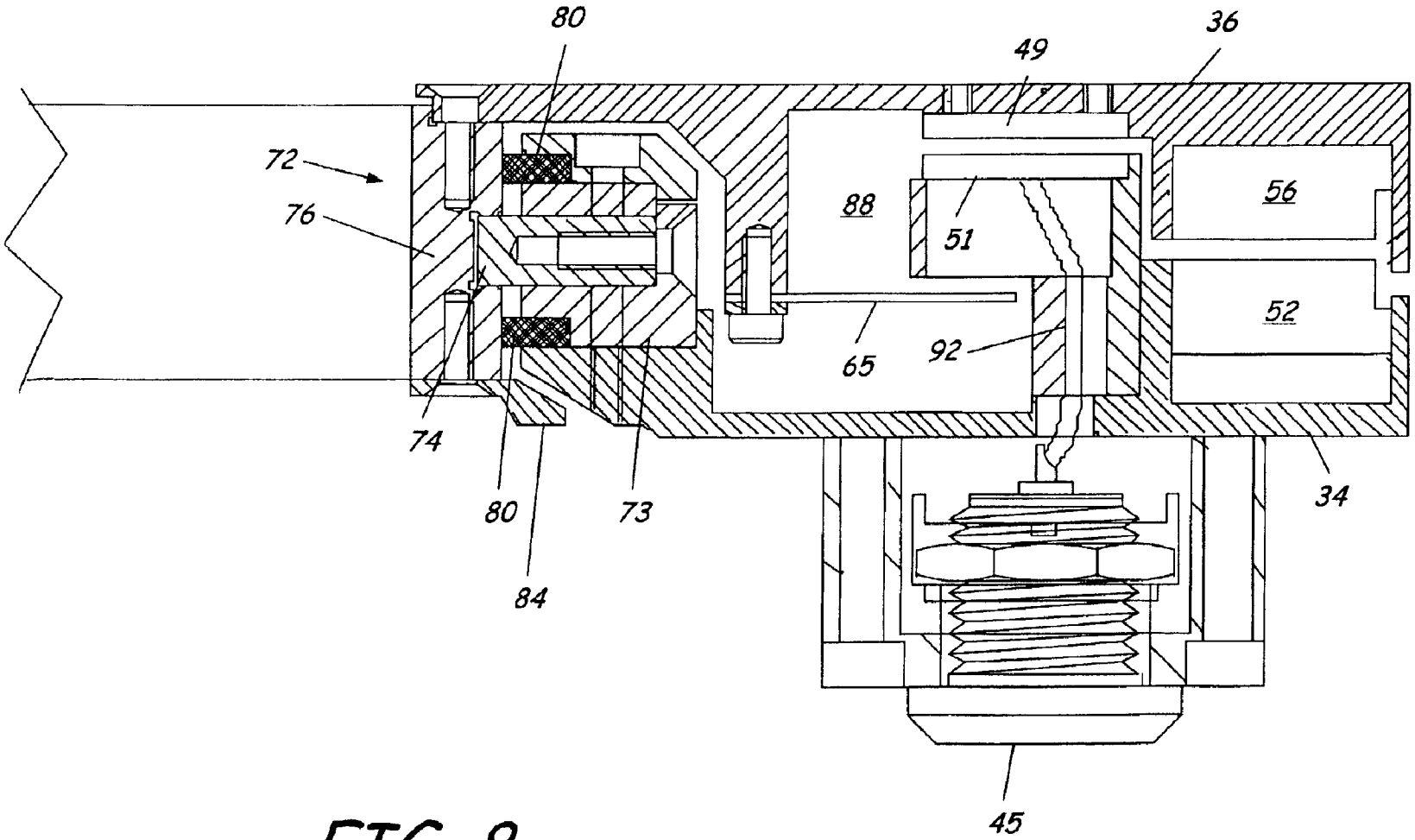
Figure 9:
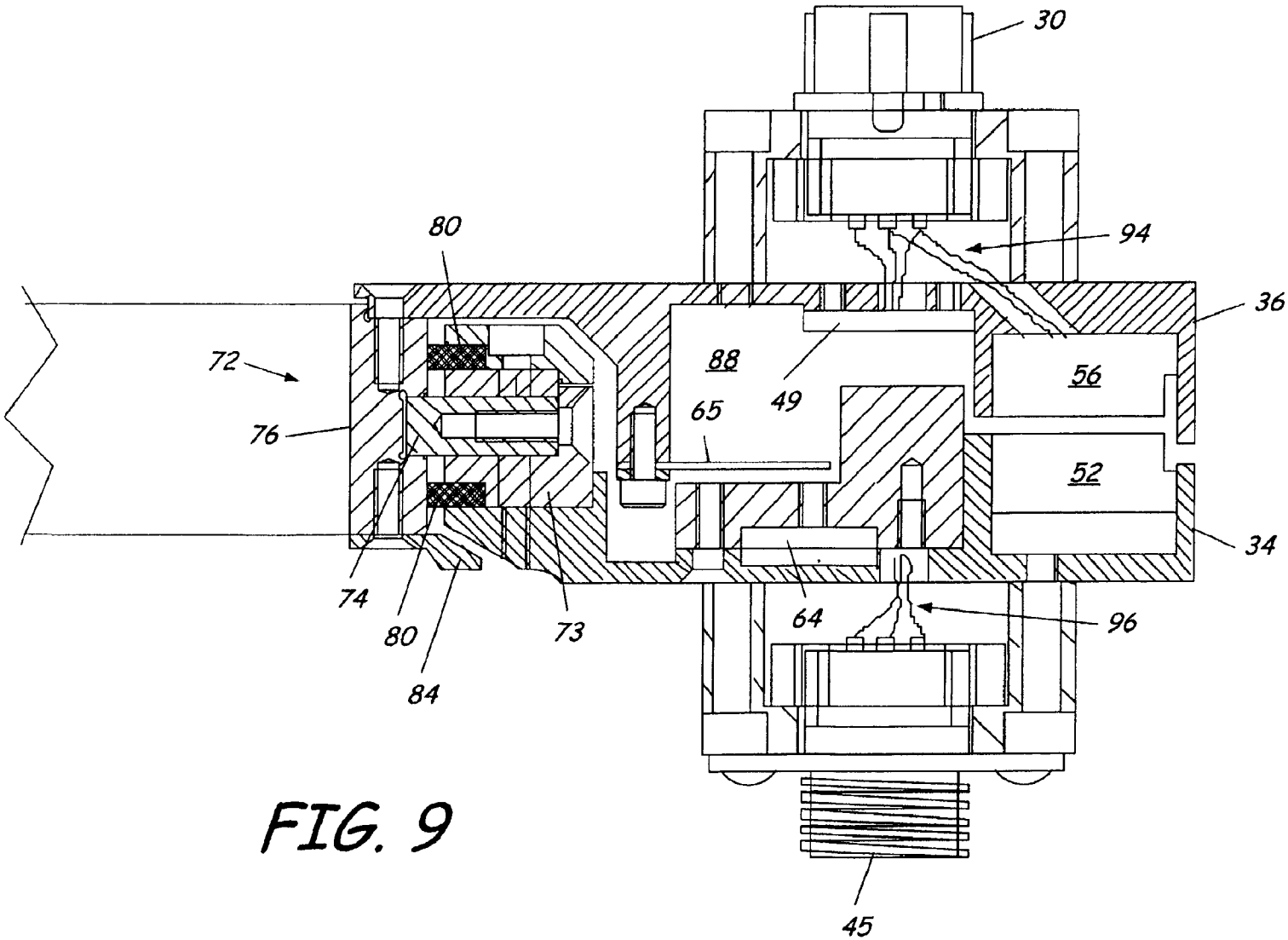

FIG. 7 is a cross section that shows a wire coupling 90 between connector 45 and power coupling 52. In addition, FIG. 8 illustrates a wire coupling 92 between connector 45 and data receiver 51. In FIG. 9, a wire coupling 94 is illustrated between connector 30 and components of rotor portion 36, namely data transmitter 49 and power regulator 56. Connector 30 is used to couple rotor portion 36 to hub electronics 19 and transducer 20. A wire coupling 96 between connector or connectors 45 and encoder sensor 64 is also shown.

Figure 10:
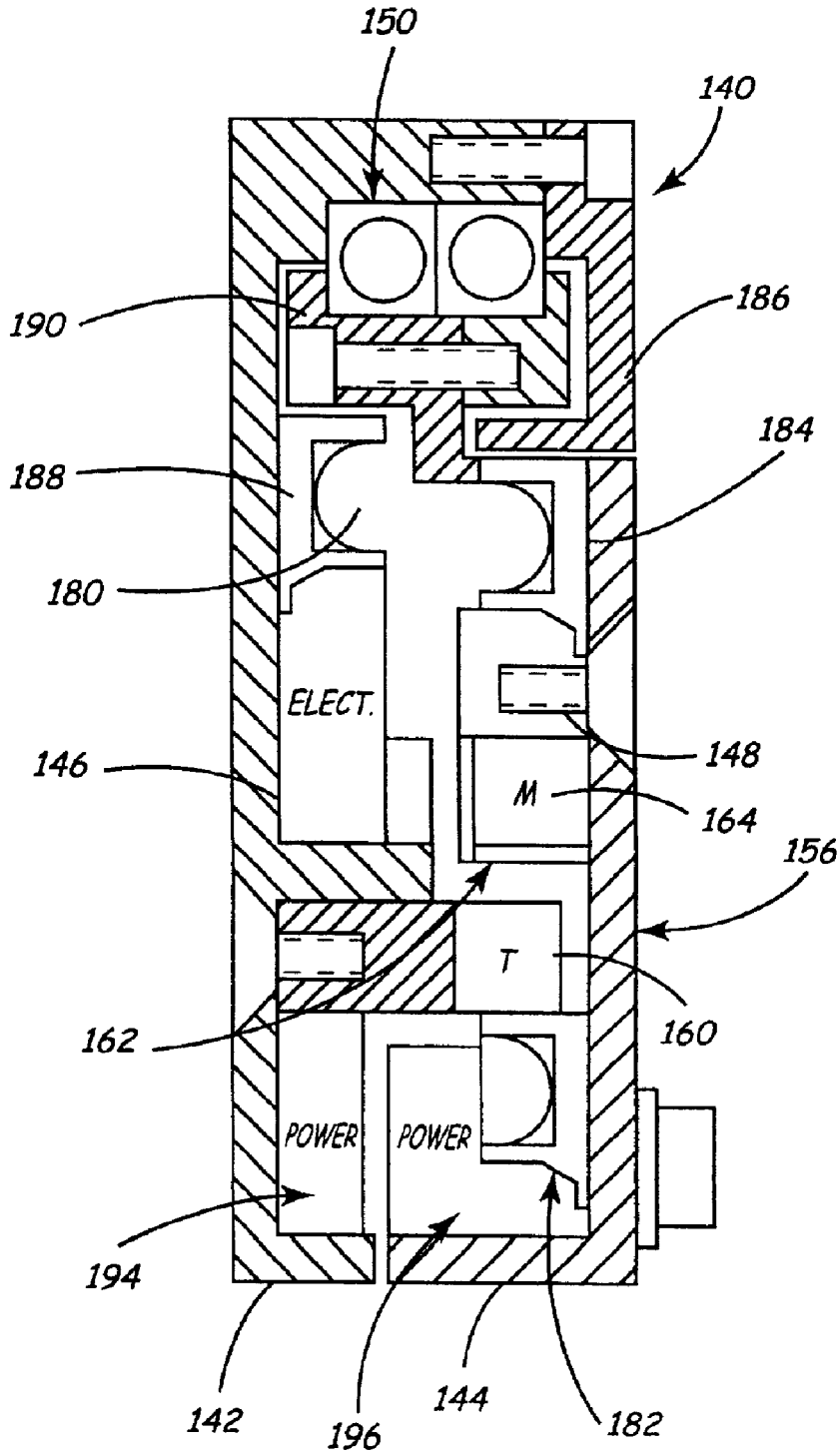
FIG. 10 is a partial sectional view of an alternative telemetry assembly.

Referring to FIG. 10, an alternative embodiment of a portion of a housing 140 including a rotor housing (or plate) 142 and a stator housing (or plate) 144 is illustrated. Like the embodiment described above, the rotor housing 142 is rotatable about the axis of rotation and relative to the stator housing 144. The rotor housing 142 is coupled to rotate with the transducer 20. The rotor housing 142 can be secured to the transducer 20 or to the hub adapter 22. A wireless coupling is provided between the rotor housing 142 and the stator housing 144. The wireless coupling allows signals from transmitter 146 to be received by the receiving antenna 148, and then transmitted to onboard data collection circuitry provided on the vehicle. A power coupling is also provided between the rotor housing 142 and the stator housing 144. The power coupling provides electrical power to the circuitry of the transducer 20, transmitter 146 and/or circuitry of hub electronics 19.

The housing 140 is self-supporting and includes a bearing assembly or guiding system 150, herein a duplex pair of angular contacting ball bearings, that supports the rotor housing 142 relative to the stator housing 144 and allows rotation thereof. In another embodiment, a single pair of radial contact bearing or four point contact bearing may be used. The power coupling is an inductive coupling and is formed between spaced apart coils 194 and 196 that are couplable to each other in order to transfer electrical power. The coils 194 and 196, like the embodiment described above, each form an annular ring about the axis of rotation and are potted in each respective housing so as to be protected from water, dirt and other contaminants.

The ring housing 140 includes an encoder 156 or other similar angular position sensing device operably coupled to the rotor housing 142 and the stator housing 144. In the embodiment illustrated, the encoder 156 comprises an incremental Hall effect device having a ring gear 160 with projecting teeth (including an index tooth) and Hall effect sensors 162 and a magnet 164. In the embodiment illustrated, the ring gear 160 is coupled to the rotor housing 142 to rotate therewith, while the magnet 164 and Hall effect sensors 162 are coupled to the stator housing 144.

In a further embodiment, two ring gears are provided which are angularly positioned one-half tooth apart from each other in order to allow for quadrature measurements to be made, thereby increasing the effect of resolution of the encoder. Other forms of encoders such as optical encoders can also be used.

The receiving antenna 148 comprises a ring or arced assembly about the axis of rotation. The transmitting antenna 146 is spaced apart from the receiving antenna 148 and generally travels in a circular path equivalent to the receiving antenna 148. The transmitted signals can be analog, digital or a combination thereof. Annular seals are provided to seal an inner cavity 180 having the transmitting antenna 146, receiving antenna 148 and encoder 156 protected from the outside environment and bearing grease from the bearing assembly 150. In the embodiment illustrated, a first annular seal 182 is provided between the stator housing 144 and an outer peripheral of the ring gear 160 of the encoder 156. A second annular seal 184 is provided between the stator housing 144 and a bearing support flange 186 of the rotor housing 142. A third annular seal 188 is provided between the rotor housing 144 and another bearing support flange 190. In the embodiment illustrated, the seals 182, 184 and 188 are spring loaded and comprise Teflon that contacts nickel, chrome or other similarly plated surfaces. Other sealing or excluding devices can be used including non-spring loaded seals, polymer seals, positive air pressure, and/or labyrinth seals could be used.

Figure 11:
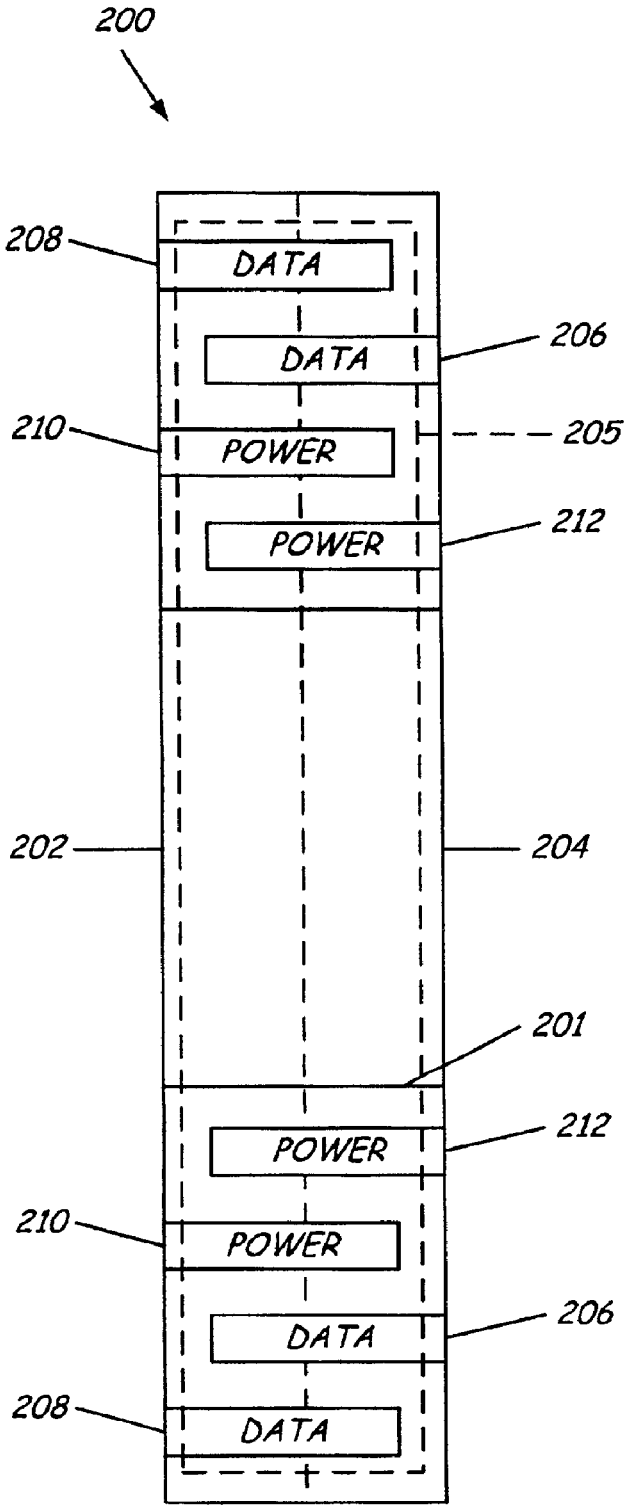
FIG. 11 is a schematic view of an alternative telemetry assembly.
Figure 12:
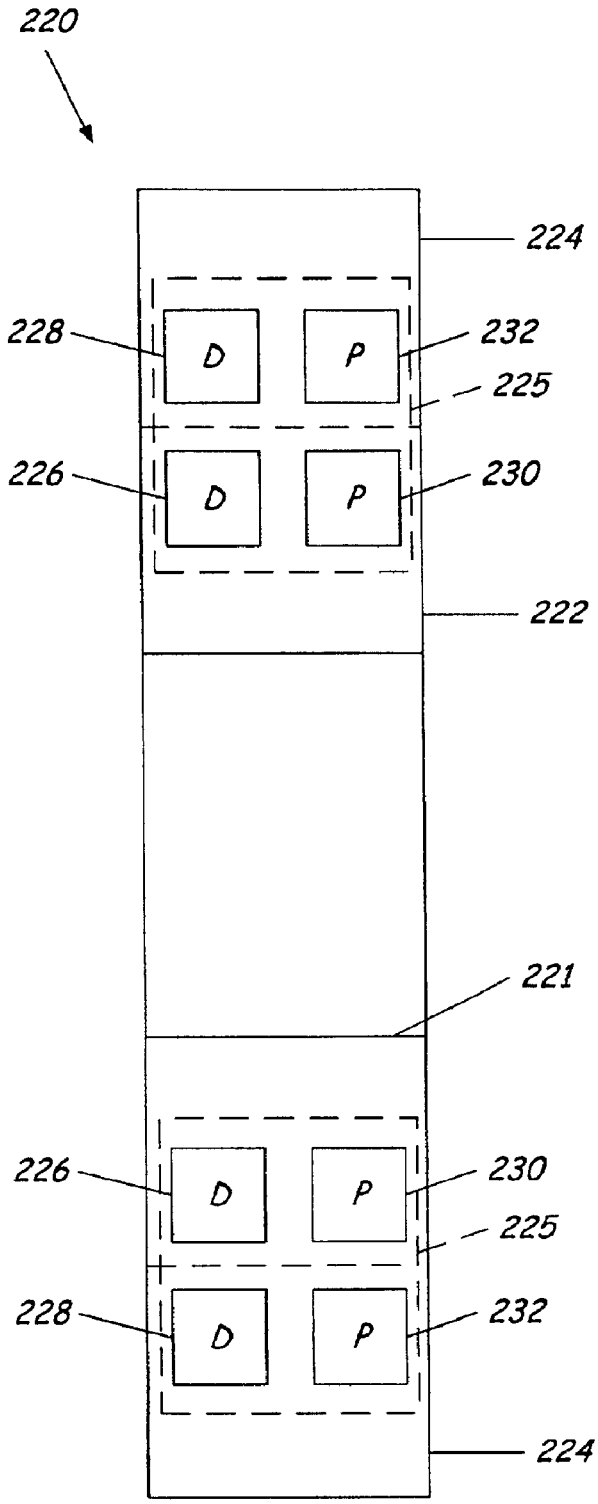
FIG. 12 is a schematic view of an alternative telemetry assembly.

As appreciated by those skilled in the art, other telemetry assembly designs can be used. FIGS. 11 and 12 illustrate alternative embodiments of telemetry assemblies according to the present invention. In FIG. 11, telemetry assembly 200 is illustrated. Telemetry assembly 200 includes central aperture 201, first portion 202 and a second portion 204. Second portion 204 rotates relative to first portion 202. Similar to the embodiments described above, first portion 202 and second portion 204 face each other to form a cavity 205 therebetween. Data is wirelessly transmitted from data transmitter 206 to data receiver 208. Data transmitter 206 and data receiver 208 are concentrically arranged. Likewise, power driver 210 and power regulator 212 are concentrically arranged and transmit power from first portion 202 to second portion 204.

FIG. 12 illustrates an embodiment of a telemetry assembly 220 including central aperture 221, a first portion 222 and a second portion 224, which rotates relative to first portion 222 in a cylindrical manner where first portion 222 has a diameter less than second portion 224 to form a cavity 225 therebetween. In other words, second portion 224 is concentrically arranged around first portion 222. In this embodiment, data can be transferred between data coupling elements 226 and 228 in the cavity. Likewise, power can be transferred between power coupling elements 230 and 232. Alternatively, first portion 222 can rotate relative to second portion 224. Data and power are transferred between data coupling units 226 and 228 and between power coupling units 230 and 232, respectively.

Generally, the elements forming the data and power couplings can be disposed at different radial distances from the axis of rotation (such as illustrated in FIGS. 11 and 12), or on opposite sides of a plane that is perpendicular to the axis of rotation (such as illustrated in FIG. 6), or a combination thereof. Likewise, the housings can be cylindrically arranged with a cavity formed therebetween, or as opposed discs on opposite sides of a plane that is perpendicular to the axis of rotation. In each of the above-described embodiments, a guiding system similar to that illustrated is provided to maintain alignment and spacing for each of the data and power couplings, thus maintaining a compact and modular telemetry assembly.

Although the present invention has been described with reference to preferred embodiments, workers skilled in the art will recognize that changes may be made in form and detail without departing from the spirit and scope of the invention.

What is claimed is:

1. In combination with a spindle having a hub rotating on bearings and coupled to a rotating member, a telemetry assembly coupled to the spindle, the telemetry assembly comprising:

a wireless transmitter coupled to the hub to rotate therewith;

a receiving antenna wirelessly coupled to the transmitter; and a guiding system coupled to the wireless transmitter and the receiving antenna to guide rotation of the wireless transmitter relative to the receiving antenna, the guiding system having a central aperture through which at least one of the spindle and the rotating member extends.

2. The combination of claim 1 wherein the receiving antenna comprises an arced assembly disposed about a spindle axis of the spindle.

3. The combination of claim 1 and further comprising a wireless power coupling including a first component mounted to the stator housing and a second component mounted to the rotor housing.

4. The combination of claim 1 and further comprising an angular sensing device operably coupled to the rotor housing and the stator housing.

5. The combination of claim 1 wherein the spindle comprises a rim and the telemetry assembly is spaced apart from the rim.

6. The combination of claim 1 wherein the spindle comprises a spindle bearing and wheel assembly, and the telemetry assembly is spaced concentrically with the spindle bearings.

7. The combination of claim 1 and further comprising a transducer mounted to the hub to rotate therewith and wherein the telemetry assembly is disposed between the hub and the transducer.

8. The combination of claim 1 wherein the rotating member is a hub adapter mounted to the hub to rotate therewith.

9. The combination of claim 1 wherein the transmitter is disposed proximate the receiving antenna and travels in a circular path similar to the receiving antenna, which is held stationary relative to the transmitting antenna in at least one translation and rotation other than rotation about the spindle axis.

10. The combination of claim 9 and further comprising:

a rotor housing supporting the transmitter and coupled to the hub to rotate therewith;

a stator housing supporting the receiving antenna; and a connection assembly coupled to the stator housing and a non-rotating element of the spindle to inhibit rotation of the stator housing.

11. The combination of claim 10 wherein the connection assembly comprises:

an elongated member secured to the non-rotating element;

a ball receiver having a cavity and secured to the telemetry assembly; and a ball coupled to the elongated member and disposed within the cavity of the ball receiver.

12. The combination of claim 10 wherein the connection assembly comprises a strap.

13. The combination of claim 10 wherein the stator housing is disposed between the connection assembly and the rotor housing.

14. A spindle mountable telemetry assembly for use on a spindle coupled to a rotating member, the telemetry assembly comprising:

a wireless transmitter;

a receiving antenna operable with the transmitter;

a first housing supporting the receiving antenna;

a second housing rotatable about an axis and relative to the first housing wherein the second housing supports the wireless transmitter; and a guiding system coupled to the first housing and the second housing to maintain position and guide rotation of the second housing relative to the first housing, the guiding system and housings including apertures adapted to allow extension of at least one of the spindle and the rotating member therethrough.

15. The telemetry assembly of claim 14 wherein the guiding system includes ball bearings coupled to the first and second housings.

16. The telemetry assembly of claim 14 and further comprising a wireless power coupling comprising a first coil coupled to the first housing and a second coil coupled to the second housing.

17. The telemetry assembly of claim 14 and further comprising a power cell rotatable with and powering the wireless transmitter.

18. The telemetry assembly of claim 14 wherein the guiding system comprises phenolic.

19. The telemetry assembly of claim 14 wherein the guiding system comprises polyaryletheretherketone (PEEK).

20. The telemetry assembly of claim 14 wherein the guiding system comprises a polyimide resin.

21. The telemetry assembly of claim 14 wherein the guiding system comprises stainless steel.

22. The telemetry assembly of claim 14 wherein the guiding system comprises a synthetic resin.

23. The telemetry assembly of claim 14 wherein the guiding system comprises a graphite filled resin.

24. The telemetry assembly of claim 14 wherein the guiding system comprises a hard-coated material.

25. The telemetry assembly of claim 14 wherein the guiding system includes a bearing pad and a bearing race having a guided groove, wherein the bearing pad is disposed in the guided groove to maintain position and allow rotation of the second housing relative to the first housing.

26. The telemetry assembly of claim 25 and further comprising a plurality of bearing pads disposed in the guided groove.

27. The telemetry assembly of claim 14 and further comprising an angular sensing device operably coupled to the first and second housings.

28. The telemetry assembly of claim 27, wherein the angular sensing device senses position of the second housing relative to the first housing and provides quadrature feedback indicative of angular position and direction of rotation of the second housing.

29. The telemetry assembly of claim 27 wherein the angular sensing device comprises an indicator and an optical sensing device to sense the presence of the indicator.

30. The telemetry assembly of claim 14 and further comprising seals disposed about the guiding system.

31. The telemetry assembly of claim 30 wherein the seals comprise synthetic material.

32. The telemetry assembly of claim 30 wherein the seals comprise polypropylene material.

33. The telemetry assembly of claim 30 wherein the seals comprise aramid material.

34. The telemetry assembly of claim 14 wherein the first and second housings comprise annular rings.

35. The telemetry assembly of claim 34 and further comprising a connection assembly secured to the first housing and mountable to a non-rotating element of the spindle.

36. The telemetry assembly of claim 34 wherein the rings are concentric.

37. The telemetry assembly of claim 35 wherein the first housing is disposed between the connection assembly and the second housing.

38. A telemetry system for a spindle, the telemetry system comprising:

a hub adapter mountable to the spindle;

a transducer mountable to the hub adapter;

a telemetry assembly mountable to a side of the transducer facing the hub adapter, the telemetry assembly comprising a stator portion supporting a receiving antenna, a rotor portion secured to at least one of the transducer and the hub adapter, the rotor portion being rotatable about an axis and relative to the stator portion, and a guiding system coupled to the stator portion and the rotor portion to guide rotation of the rotor portion relative to the stator portion; and a wireless transmitter coupled to the stator portion and receiving signals from the transducer and having a transmitting antenna operable with the receiving antenna.

39. The telemetry system of claim 38 and further comprising an angular sensing device operably coupled to the rotor portion and the stator portion.

40. The telemetry system of claim 38 wherein the rotor portion is disposed between the stator portion and the transducer.

41. The telemetry system of claim 38 and further comprising a wireless power coupling to power the wireless transmitter, the wireless power coupling comprising a first coil mounted to the stator portion and a second coil mounted to the rotor portion.

42. The telemetry system of claim 38 wherein the rotor portion faces the stator portion and is rotatable in a circular path substantially similar to the stator portion.

43. The telemetry system of claim 42 wherein the guiding system includes a central aperture adapted to allow extension of at least one of the spindle and a rotating member coupled to the spindle therethrough.

44. In combination with a spindle having a hub rotating on bearings and coupled to a rotating member, a telemetry assembly coupled to the spindle, the telemetry assembly comprising:

a first housing having a data receiver;

a second housing having a data transmitter coupled to the data receiver;

means for guiding the second housing relative to the first housing; and means for connecting the first housing to a non-rotating element of the spindle.

45. The telemetry system of claim 44 and further comprising:

means for sensing an angular position of the second housing relative to the first housing.

46. The telemetry system of claim 44 and further comprising:

means for inhibiting translational motion of the first housing relative to the second housing;

means for inhibiting rotational motion of the first housing relative to the second housing in all axis other than the axis of rotation allowed by the means for guiding.

47. The telemetry system of claim 44 and further comprising:

means for maintaining a gap between the data receiver and the data transmitter.

* * * * *